US011488794B1

(12) United States Patent
Kao

(10) Patent No.: US 11,488,794 B1
(45) Date of Patent: Nov. 1, 2022

(54) FUSE TUBE DEVICE AND LOAD BREAK FUSE CUTOUT ASSEMBLY HAVING IHE SAME

(71) Applicant: GOODWELL ELECTRIC CORPORATION, Taipei (TW)

(72) Inventor: Sui-Chan Kao, Taipei (TW)

(73) Assignee: GOODWELL ELECTRIC CORPORATION, Taipei (TW)

( * ) Notice: Subject to any disclaimer, the term of this patent is extended or adjusted under 35 U.S.C. 154(b) by 0 days.

(21) Appl. No.: 17/540,412

(22) Filed: Dec. 2, 2021

(30) Foreign Application Priority Data

Nov. 17, 2021 (TW) ..... 110142679

(51) Int. Cl.

| | |
|---|---|
| ***H01H 31/12*** | (2006.01) |
| ***H01H 85/20*** | (2006.01) |
| ***H01H 85/175*** | (2006.01) |
| ***H01H 85/30*** | (2006.01) |
| ***H01H 85/38*** | (2006.01) |
| ***H01H 85/43*** | (2006.01) |
| *H01H 85/08* | (2006.01) |
| *H01H 85/02* | (2006.01) |

(52) U.S. Cl.

CPC ..... *H01H 31/127* (2013.01); *H01H 31/12* (2013.01); *H01H 85/175* (2013.01); *H01H 85/2045* (2013.01); *H01H 85/303* (2013.01); *H01H 85/38* (2013.01); *H01H 85/43* (2013.01); *H01H 85/0241* (2013.01); *H01H 85/08* (2013.01); *H01H 2085/0291* (2013.01); *H01H 2085/383* (2013.01)

(58) Field of Classification Search

CPC .. H01H 31/127; H01H 85/0241; H01H 85/08; H01H 85/175; H01H 85/2045; H01H 85/303; H01H 85/38; H01H 85/43; H01H 2085/0291; H01H 2085/381; H01H 2085/383

See application file for complete search history.

(56) References Cited

U.S. PATENT DOCUMENTS 2,961,518 A * 11/1960 Hermann ..... H01H 31/127 337/5
3,917,374 A * 11/1975 Murdock ..... H01H 33/77 439/586
2002/0158745 A1* 10/2002 Haynam ..... H01H 31/023 337/171

(Continued)

*Primary Examiner* — Jacob R Crum

(57) ABSTRACT

A fuse tube device is disclosed. The fuse tube device is allowed to be assembled with an insulation device so as to form a load break fuse cutout fully closed. The fuse tube comprises: an insulation housing, an accommodation tube, a first electrical connection unit, a second electrical connection unit, a conductive rod, a fuse element, a first conductive plate, a first cover, a second conductive plate, and a second cover. When assembling the fuse tube device with the insulation device, a first embedding member and a second embedding member of the insulation housing are embedded into a first terminal connecting opening and a second terminal connecting opening of the insulation device, such that the first electrical connection unit and the second electrical connection unit contact a first terminal connecting member and a second terminal connecting member of the insulation device, respectively.

20 Claims, 15 Drawing Sheets

(56) References Cited

U.S. PATENT DOCUMENTS

2007/0293073 A1* 12/2007 Hughes ..... H01H 33/66207
439/186
2008/0174399 A1* 7/2008 Benke ..... H01H 31/127
337/168
2009/0091416 A1* 4/2009 Tang ..... H02J 50/12
337/171
2009/0322463 A1* 12/2009 Van Heerden ..... H01H 85/28
337/237
2010/0230263 A1* 9/2010 Haj-Maharsi ..... H01H 31/127
200/48 R
2011/0094342 A1* 4/2011 Creech ..... H01H 31/127
81/3.8
2012/0055695 A1* 3/2012 Zhang ..... C08J 5/244
174/138 C
2015/0270087 A1* 9/2015 Siebens ..... H01H 85/22
337/171
2016/0013004 A1* 1/2016 Kester ..... H01H 85/2045
337/202
2016/0240336 A1* 8/2016 Weng ..... H01H 31/12
2017/0059640 A1* 3/2017 Haensgen ..... H01H 9/167

* cited by examiner

FUSE TUBE DEVICE AND LOAD BREAK FUSE CUTOUT ASSEMBLY HAVING IHE SAME

BACKGROUND OF THE INVENTION

1. Field of the Invention

The present invention relates to the technology field of fuse cutout, and more particularly to a fuse tube device and load break fuse cutout assembly having the fuse tube device.

2. Description of the Prior Art

With reference to FIG. 1, there is shown a side view of a conventional load break fuse cutout. Moreover, FIG. 2 shows a stereo diagram of the conventional load break fuse cutout. According to FIG. 1 and FIG. 2, the conventional load break fuse cutout 1*a* comprises: an insulator 11*a*, a fuse tube 12*a*, a first fixing unit 13*a*, a first conductor connecting unit 14*a*, a conductive plate spring 10*a*, a second fixing unit 15*a*, a second conductor connecting unit 16*a*, a toggle mechanism 17*a*, and a mounting bracket 18*a*, wherein there is a fuse element disposed in the fuse tube 12*a*.

As FIG. 1 shows, a first conductor coupled to a power source is connected to the first conductor connecting unit 14*a*, and a second conductor coupled to a load terminal is connected to the second conductor connecting unit 16*a*. Therefore, electric power is transmitted from the first conductor to the fixing unit 13*a* and the conductive plate spring 10*a* via the first conductor connecting unit 14*a*, and is further transmitted to a first electrical connecting element 121*a* disposed on the top of the fuse tube 12*a*. Furthermore, the first electrical connecting element 121*a* transmits the electric power to the fuse element, such that the electric power is further transmitted from the fuse element to a second electrical connecting element 124*a* disposed on the bottom of the fuse tube 12*a*, and is eventually transmitted to the load terminal via the second conductor connecting unit 16*a* and the second conductor.

It is well known that, in case of a power system being in a condition of abnormal overload or short-circuit, overcurrent causes the fuse element (also called fuse link) in the fuse tube 12*a* to melt. In such case, electric arc immediately takes place in the fuse tube 12*a*, thereby heating arc-extinguishing elements in the fuse tube 12*a* so as to explode a lot of gas. After that, high pressure is produced in the fuse tube 12*a*, leading the electric arc to be blew off in the fuse tube 12*a*. As described in more detail below, melting of the fuse element causes the contact between the first electrical connecting element 121*a* and the conductive plate spring 10*a* be not tightened like before, therefore the fuse tube 12*a* drops out due to the action of the toggle mechanism 17*a* (as FIG. 2 shows). In such case, the load break fuse cutout 1*a* is in an open position, such that the overcurrent is prevented from flowing into the load terminal via the second conductor connecting unit 16*a*.

It is worth mentioning that, during the normal operation of the load break fuse cutout 1*a*, an engineering staff is allowed to operate a load break tool to connect a pull ring 123*a* and/or a pull hook 122*a* of the fuse tube 12*a*, and then to directly pull the fuse tube 12*a* to drop out. As described in more detail below, commonly, an upper cover is adopted for shielding the first fixing unit 13*a*, the first conductor connecting unit 14*a*, the conductive plate spring 10*a*, and the first electrical connecting element 121*a*, and a lower cover is adopted for shielding the second conductor connecting unit 16*a*, the toggle mechanism 17*a*, and the second electrical connecting element 124*a*. The upper cover and the lower cover protect birds, kites, and branches from electrocution, which may also trigger an over-current condition that causes a power outage.

Generally, the load break fuse cutout 1*a* is applied in an electric power system, and is used in primary overhead feeder lines and taps to protect distribution transformers from current surges and overloads. According to experiences, the load break fuse cutout 1*a* shows many drawbacks in practical use. The drawbacks are summarized as follows.

(1) the upper cover and the lower cover both have a semi-closed housing, and that means there is still a chance for birds, kites, and/or branches to cause electrocution by touching the conductive articles covered by the upper cover and/or the lower cover.

(2) Because being covered by the upper cover, it is hard for the engineering staff to control a load break tool to connect a pull ring 123*a* and/or a pull hook 122*a* of the fuse tube 12*a*. Moreover, it is worth mentioning that, during using the load break tool to directly pull the fuse tube 12*a* to drop out (as FIG. 2 shows), electric arc is produced between the conductive plate spring 10*a* and the first electrical connecting element 121*a*.

(3) Because the fuse tube 12*a* is assembled with the insulator 11*a* through the toggle mechanism 17*a*, it is impossible for the engineering staff staying on the ground to control the load break tool or a specially-designed tool to replace the fuse tube 12*a* of the load break fuse cutout 1*a* by a new one.

From the above descriptions, it is understood that there is room for improvement in the conventional the load break fuse cutout. In view of that, the inventor of the present application has made great efforts to make inventive research and eventually provided a fuse tube device and load break fuse cutout assembly having the fuse tube device.

SUMMARY OF THE INVENTION

The primary objective of the present invention is to disclose a fuse tube device, which is allowed to be assembled with an insulation device so as to form a load break fuse cutout fully closed.

For achieving the primary objective mentioned above, the present invention provides an embodiment of the fuse tube device, comprising;

an insulation housing, wherein a top and a bottom of the insulation housing have a first opening and a second opening, respectively, and a first embedding member and a second embedding member are formed on a first side of the insulation housing; an accommodation tube, being disposed in the insulation housing;

a first electrical connection unit, being disposed in the insulation housing, and comprising a first cylinder member and a first electrical terminal connected with the first cylinder member; wherein the first cylinder member has a first connection opening and a second connection opening, one end of the accommodation tube passing through the second connection opening so as to be positioned in the first cylinder member, and the first electrical terminal protruding out of the insulation housing through the first embedding member;

a second electrical connection unit, being disposed in the insulation housing, and comprising a second cylinder member and a second electrical terminal connected with the second cylinder member; wherein the second cylinder member has a third connection opening and a fourth connection opening, another one end of the accommodation tube passing through the fourth connection opening so as to be positioned in the second cylinder member, and the second electrical terminal protruding out of the insulation housing through the second embedding member;

a conductive rod, being disposed in the insulation housing, and having a first end and a second end, wherein the first end is positioned in the first cylinder member, and a first electrical member being disposed on the first end;

a fuse element, being disposed in the insulation housing, and having a first terminal and a second terminal, wherein the first terminal contacts the first electrical member;

a first conductive plate, being connected to the first cylinder member for covering the first connection opening, and a second electrical member is disposed on an inner surface of the first conductive plate for contacting the second terminal of the fuse element; a first cover, being connected to the insulation housing for shielding the first opening, and having a first recess for receiving the first conductive plate and a portion of the first cylinder member;

a second conductive plate, being stuck in the second cylinder member, and having a first through hole, wherein the conductive rod passes through the first through hole, so as to make the second conductive plate be positioned near the second end of the conductive rod; and a second cover, being connected to the insulation housing for shielding the second opening.

Moreover, the present invention also provides an embodiment of a load break fuse cutout assembly fully closed, comprising;

an insulation device, comprising:

a first a full-closed cylindrical insulator oriented vertically;

a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;

a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;

a first electrical connection unit, being accommodated in the first cylindrical insulator, and having a first terminal connecting member that is positioned in the first terminal connecting opening and a first able connecting member that is positioned in the first cable connection opening;

a second electrical connection unit, being accommodated in the second cylindrical insulator, and having a second terminal connecting member that is positioned in the second terminal connecting opening and a second cable connecting member that is positioned in the second cable connection opening; and a fuse tube, comprising:

an insulation housing, wherein a top and a bottom of the insulation housing have a first opening and a second opening, respectively, and a first embedding member and a second embedding member are formed on a first side of the insulation housing;

an accommodation tube, being disposed in the insulation housing;

a first electrical connection unit, being disposed in the insulation housing, and comprising a first cylinder member and a first electrical terminal connected with the first cylinder member; wherein the first cylinder member has a first connection opening and a second connection opening, one end of the accommodation tube passing through the second connection opening so as to be positioned in the first cylinder member, and the first electrical terminal protruding out of the insulation housing through the first embedding member;

a second electrical connection unit, being disposed in the insulation housing, and comprising a second cylinder member and a second electrical terminal connected with the second cylinder member; wherein the second cylinder member has a third connection opening and a fourth connection opening, another one end of the accommodation tube passing through the fourth connection opening so as to be positioned in the second cylinder member, and the second electrical terminal protruding out of the insulation housing through the second embedding member;

a conductive rod, being disposed in the insulation housing, and having a fifth end and a sixth end, wherein the first end is positioned in the first cylinder member, and a first electrical member being disposed on the fifth end;

a fuse element, being disposed in the insulation housing, and having a first terminal and a second terminal, wherein the first terminal contacts the first electrical member;

a first conductive plate, being connected to the first cylinder member for covering the first connection opening, and a second electrical member is disposed on an inner surface of the first conductive plate for contacting the second terminal of the fuse element;

a first cover, being connected to the insulation housing for shielding the first opening, and having a first recess for receiving the first conductive plate and a portion of the first cylinder member;

a second conductive plate, being stuck in the second cylinder member, and having a first through hole, wherein the conductive rod passes through the first through hole, so as to make the second conductive plate be positioned near the sixth end of the conductive rod; and a second cover, being connected to the insulation housing for shielding the second opening;

wherein when assembling the fuse tube device with the insulation device, the first embedding member and the second embedding member are embedded into the first terminal connecting opening and the second terminal connecting opening, such that the first electrical terminal and the second electrical terminal contact the first terminal connecting member and the second terminal connecting member, respectively.

In one embodiment, there is a hooking member provided on a second side of the insulation housing, and the hooking member having a hooking opening that consists of a horizontal rectangular portion, a vertical rectangular portion and a circular portion.

In one embodiment, the insulation housing is formed with a plurality of weathersheds thereon.

In one embodiment, a first arc extinguishing member is connected to a top end of the first electrical terminal, and a second arc extinguishing member is connected to a top end of the second electrical terminal.

In one embodiment, there are a plurality of vent holes formed on the second conductive plate, the second cover is made of an elastic material, and has a second recess that is formed with a third opening on a bottom thereof.

In one embodiment, there are a plurality of narrow grooves formed on the second cover to surround the third opening.

In one embodiment, the fuse tube device further comprises:

an accommodation member, being disposed in the second recess, wherein a top and a bottom of the accommodation member have a fourth opening and a fifth opening, respectively, the fifth opening being larger than the third opening, and the second conductive plate simultaneously covering the fourth opening;

a mass block, being disposed in the accommodation member, and having a recessed groove for receiving the sixth end of the conductive rod;

a stopping block, being disposed on the second plate and having a second through hole, wherein the conductive rod simultaneously passes through the second through hole;

a corrugated gasket, being disposed on the stopping block, and having a third through hole, wherein the conductive rod) simultaneously passes through the third through hole;

a first tube, being disposed in the accommodation tube and accommodating the conductive rod therein, wherein two ends of the first tube contact the first conductive plate and the corrugated gasket, respectively; and a second tube, being disposed in the first tube, wherein two ends of the second tube contact the second electrical member and the first electrical member, respectively.

In one embodiment, the mass block is coated with a polymer layer.

BRIEF DESCRIPTION OF THE DRAWINGS

The invention, as well as a preferred mode of use and advantages thereof, will be best understood by referring to the following detailed description of an illustrative embodiment in conjunction with the accompanying drawings, wherein.

DETAILED DESCRIPTION OF THE PREFERRED EMBODIMENTS

To more clearly describe a fuse tube device and a load break fuse cutout assembly having the fuse tube device disclosed by the present invention, embodiments of the present invention will be described in detail with reference to the attached drawings hereinafter.

Fuse Tube Device

Figure 1:
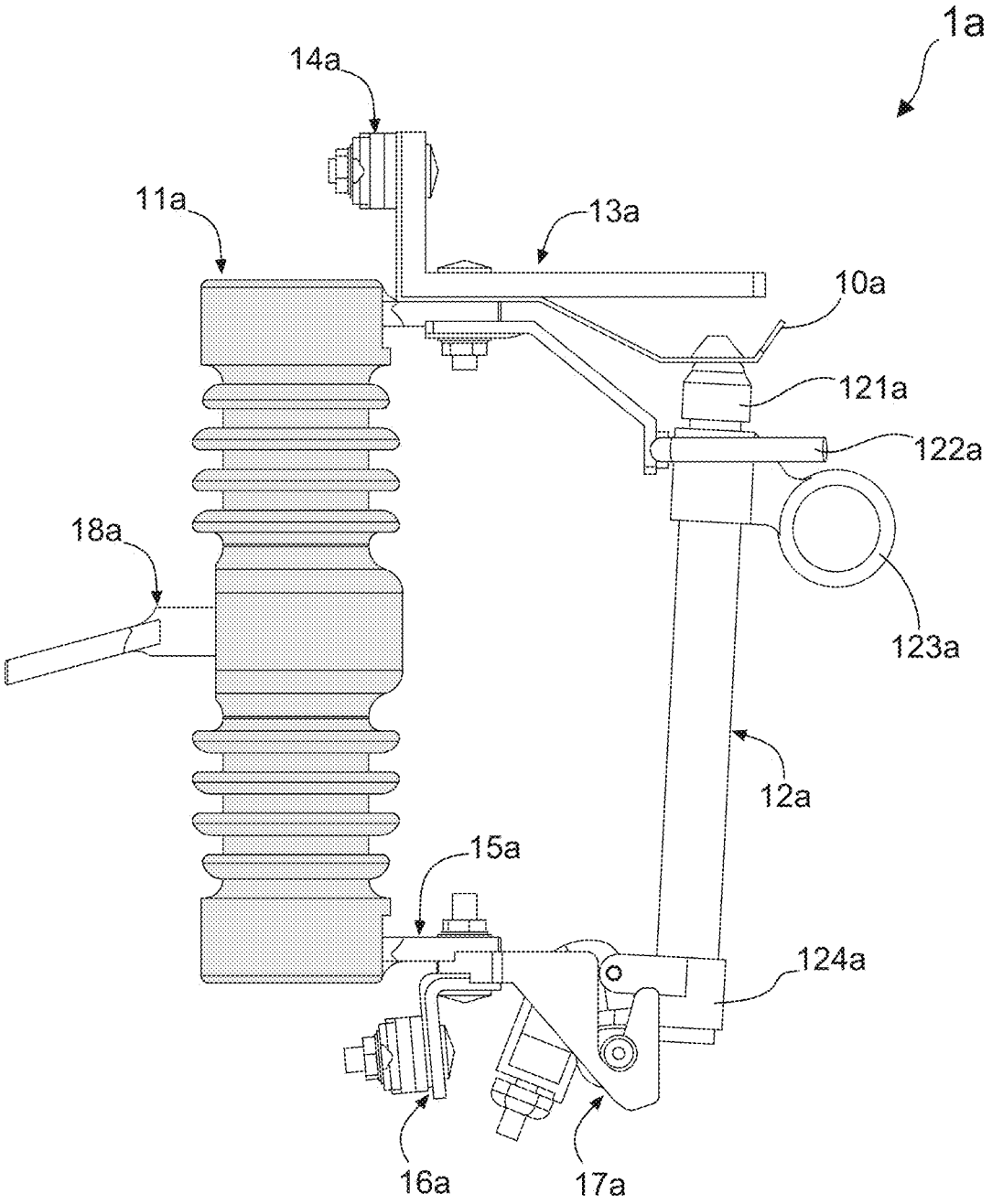
FIG. 1 (Prior art)
FIG. 1 shows a side view of a conventional load break fuse cutout.
Figure 2:
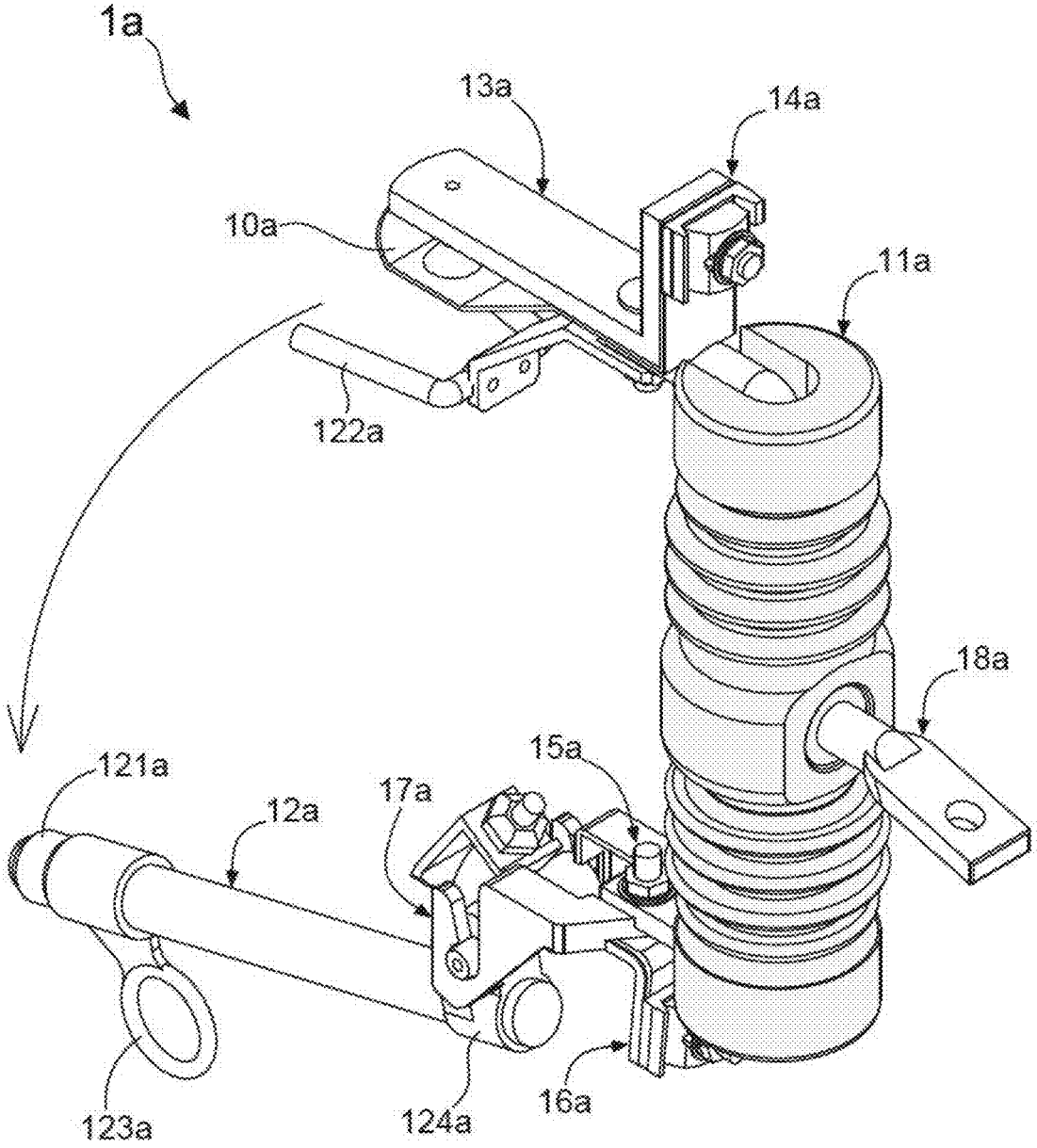
FIG. 2 (Prior art)
FIG. 2 shows a stereo diagram of the conventional load break fuse cutout.
Figure 3A:
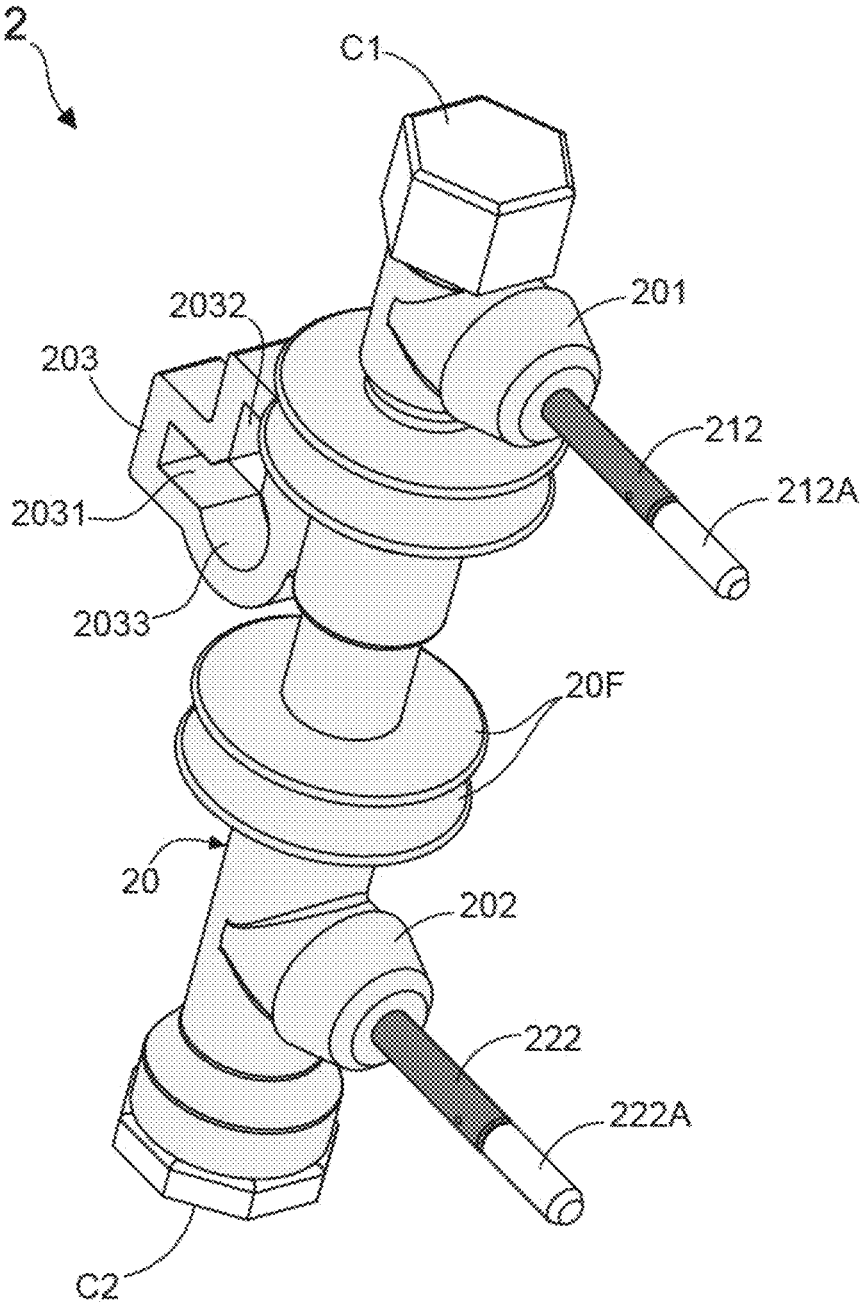
FIG. 3A shows a first stereo diagram of a fuse tube device according to the present invention.
Figure 3B:
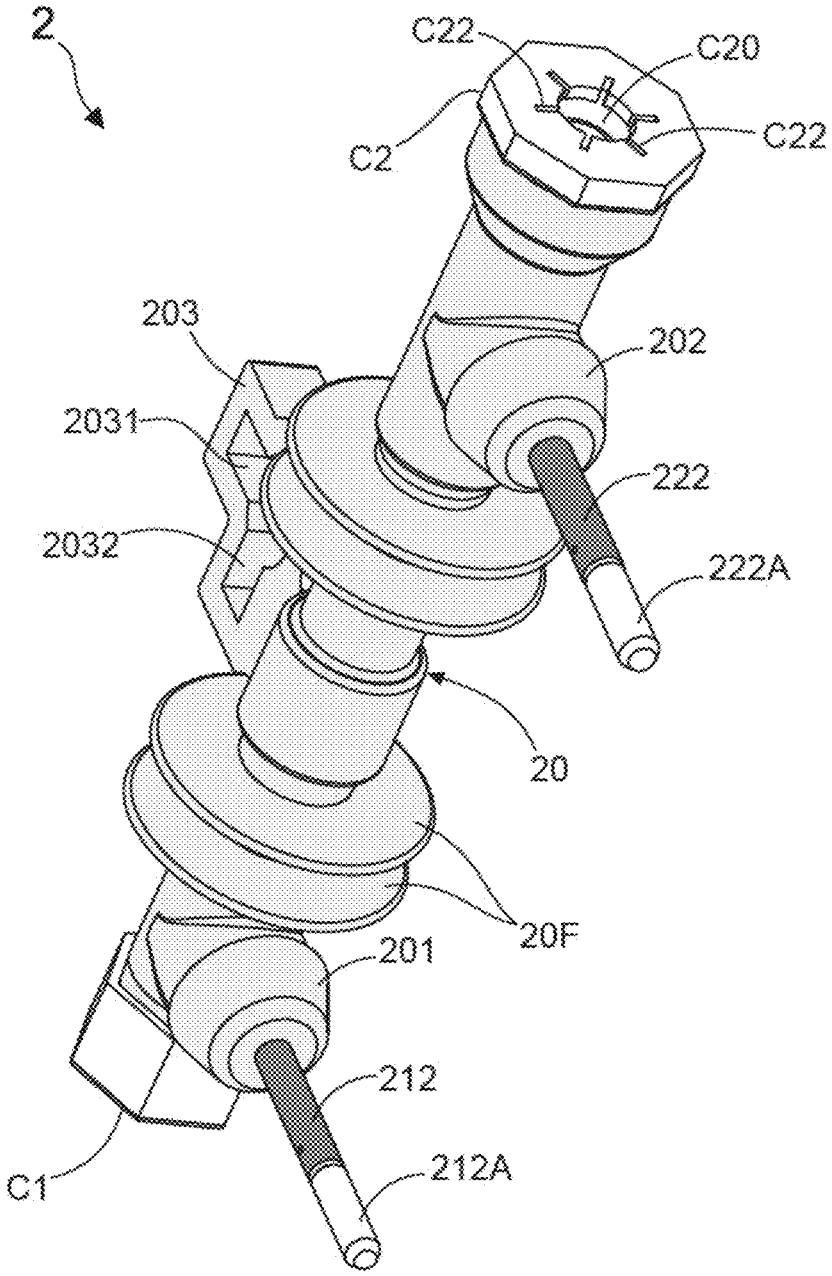
FIG. 3B shows a second stereo diagram of the fuse tube device according to the present invention.
Figure 4A:
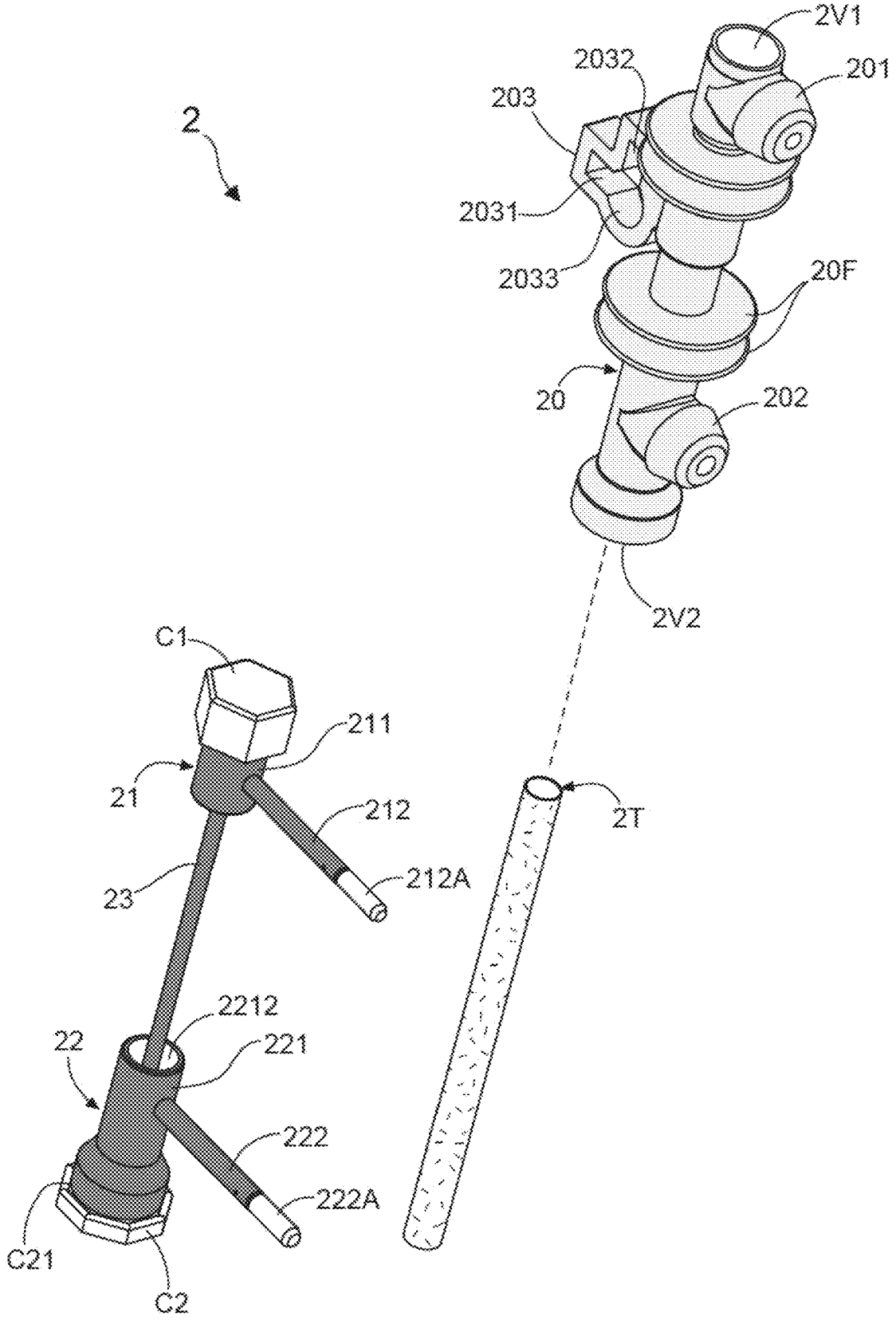
FIG. 4A shows a first explode view of the fuse tube device according to the present invention.
Figure 4B:
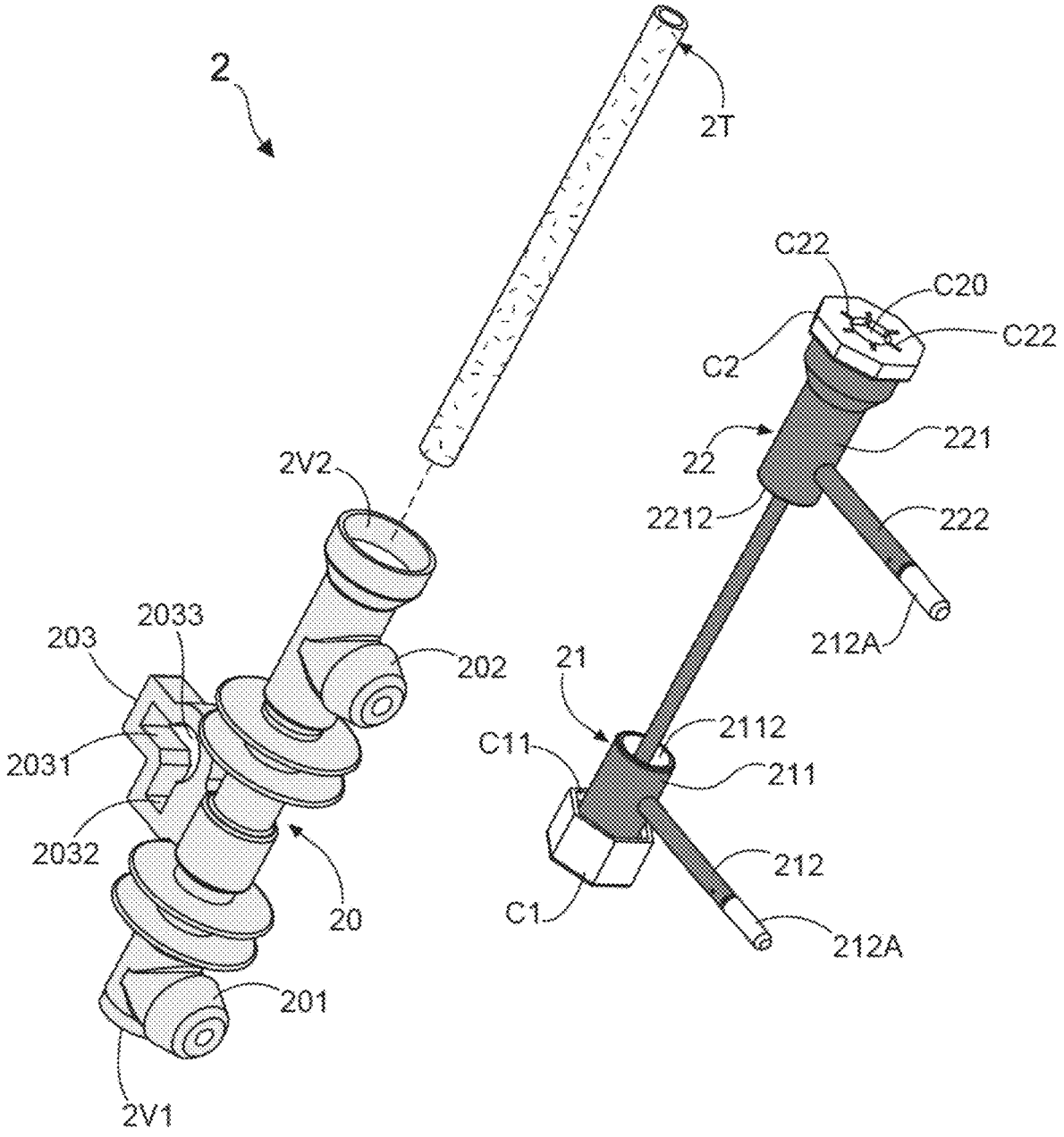
FIG. 4B shows a second explode view of the fuse tube device according to the present invention.
Figure 4C:
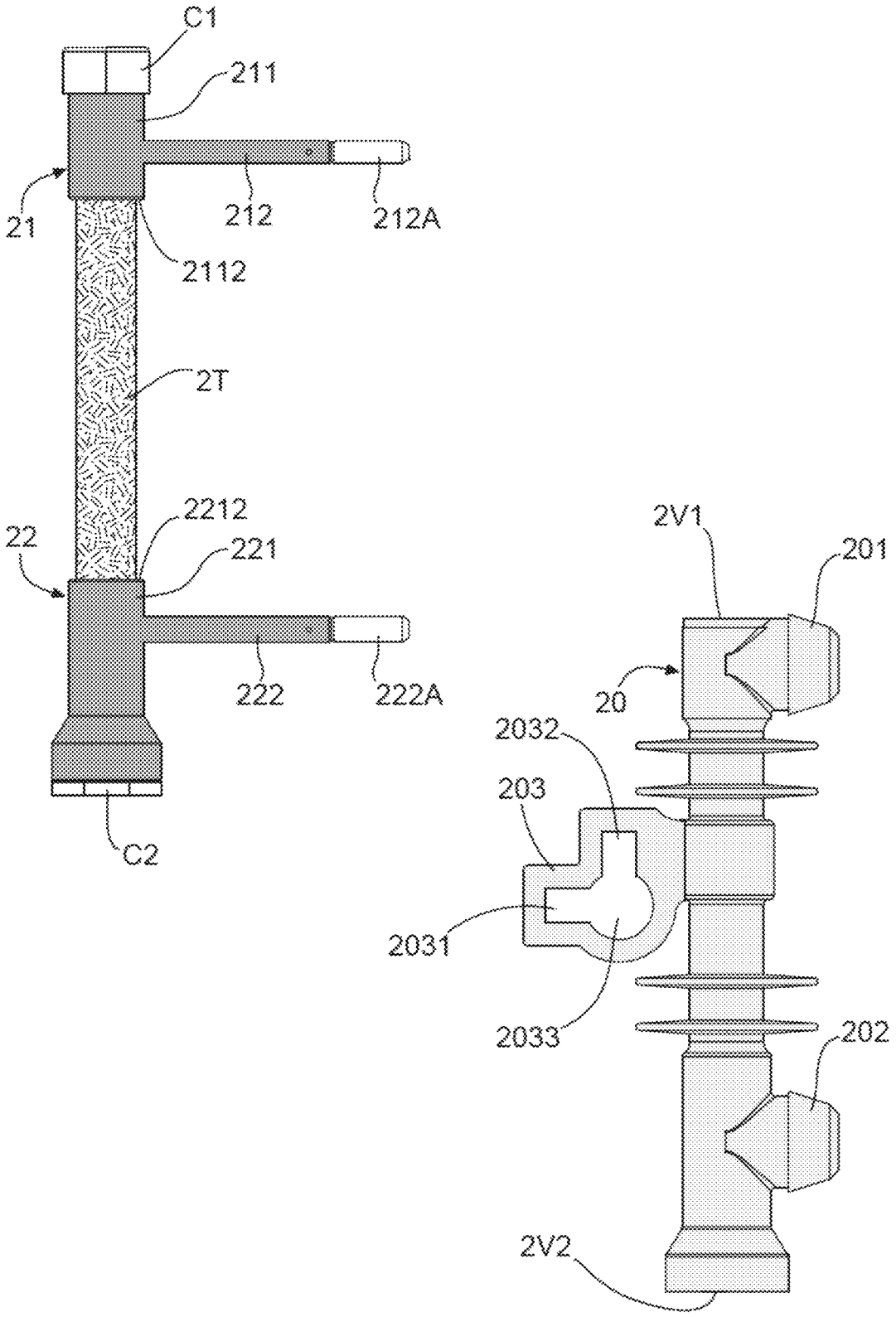
FIG. 4C shows a third explode view of the fuse tube device according to the present invention.
Figure 5A:
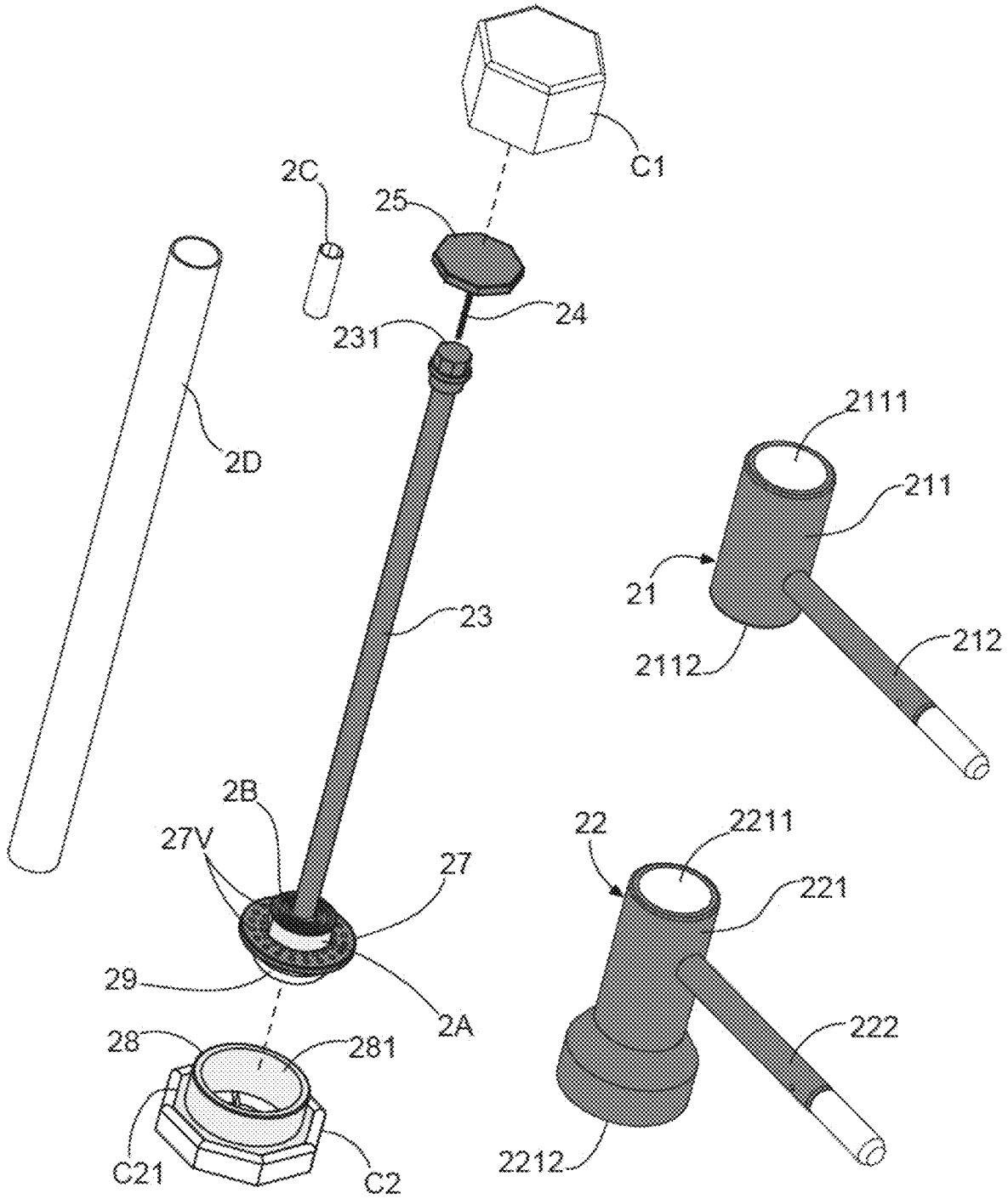
FIG. 5A shows a fourth explode view of the fuse tube device according to the present invention.
Figure 5B:
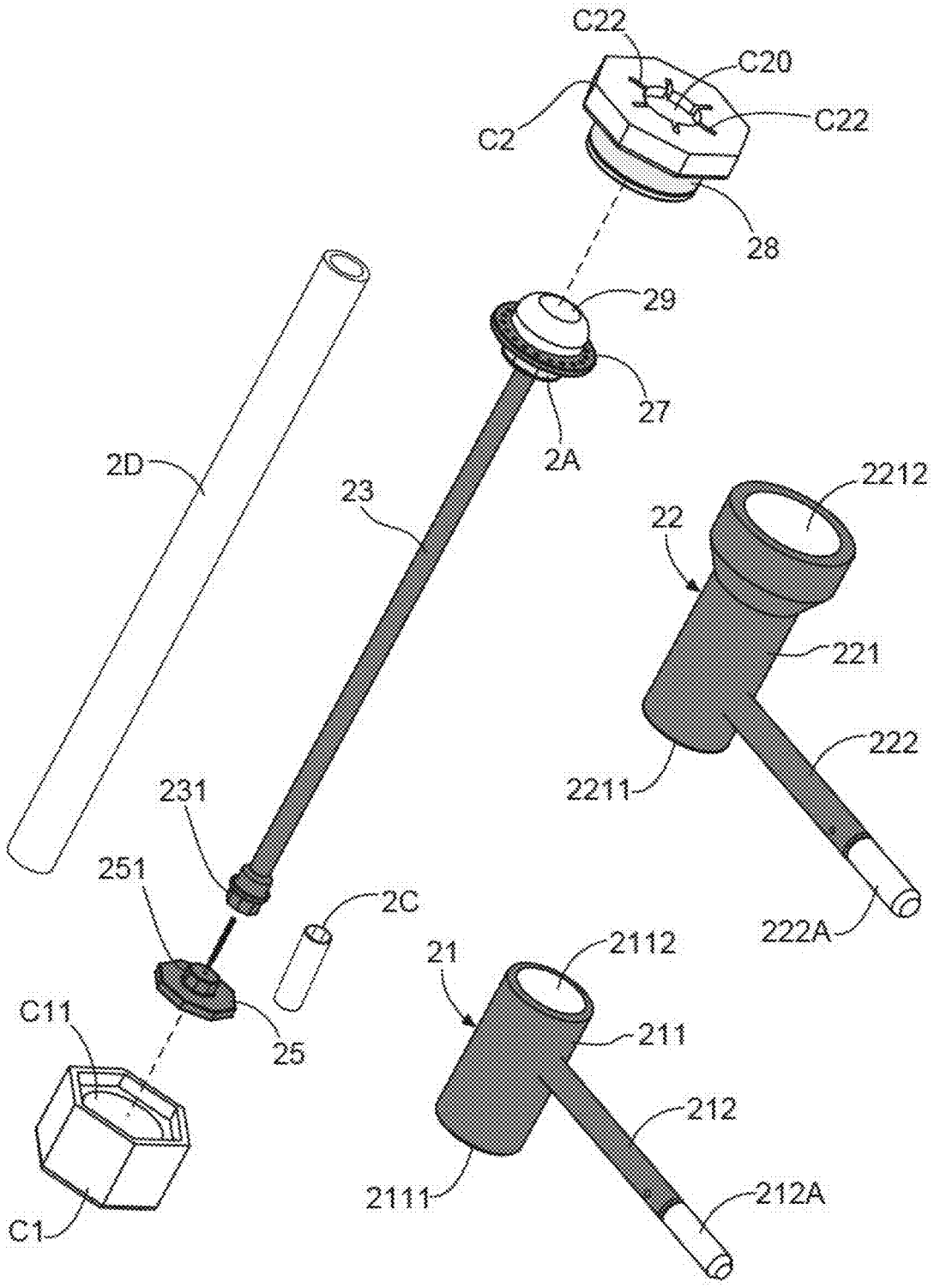
FIG. 5B shows a fifth explode view of the fuse tube device according to the present invention.
Figure 5C:
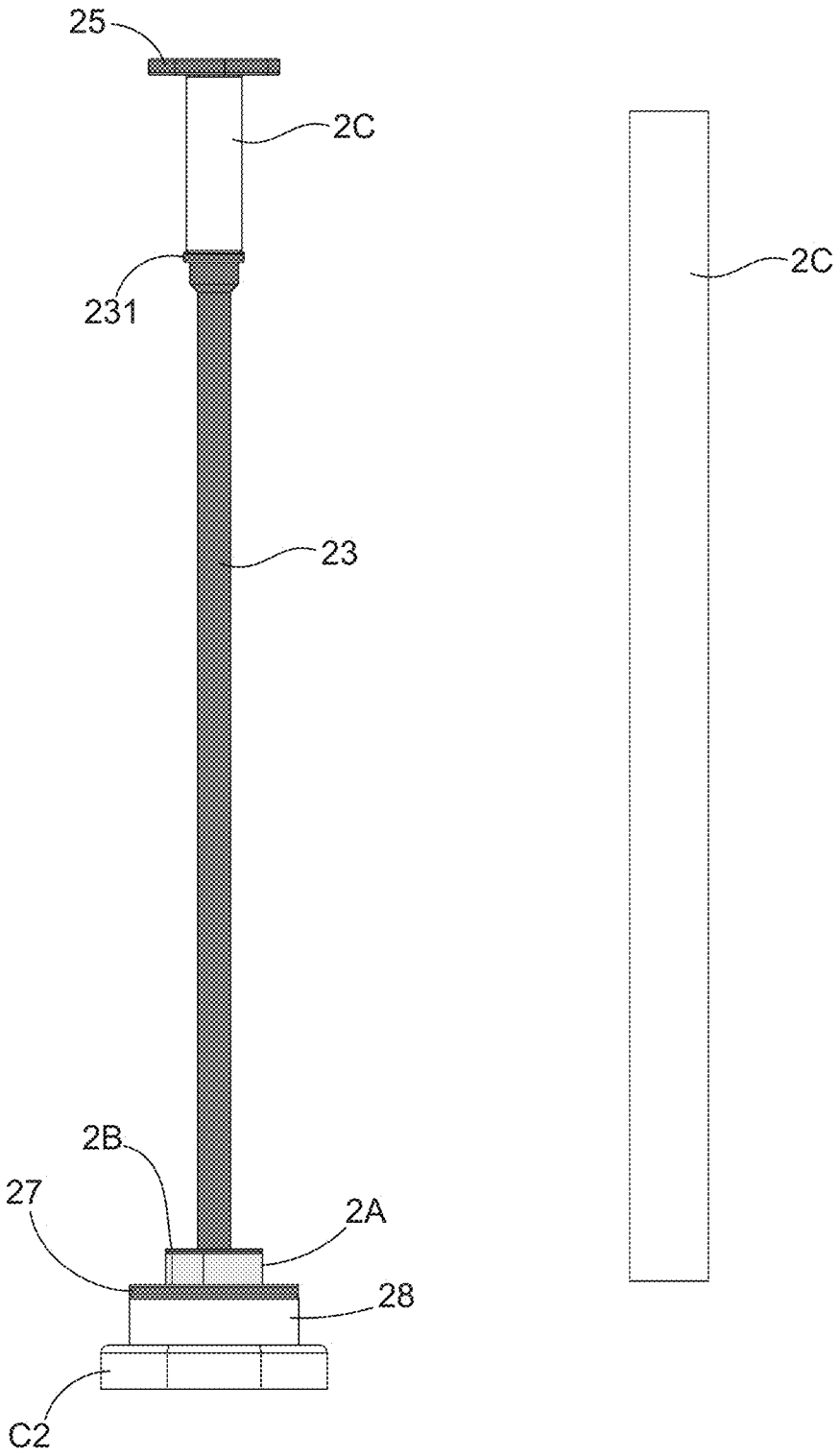
FIG. 5C shows a sixth explode view of the fuse tube device according to the present invention.

With reference to FIG. 3A and FIG. 3B, there are shown a first stereo diagram and a second stereo diagram of a fuse tube device according to the present invention. Moreover, FIG. 4A, FIG. 4B and FIG. 4C provide a first explode view, a second explode view and a third explode view of the fuse tube device according to the present invention. Furthermore, FIG. 5A, FIG. 5B and FIG. 5C provide a fourth explode view, a fifth explode view and a sixth explode view of the fuse tube device. The present invention discloses a fuse tube device 2, which is allowed to be assembled with an insulation device so as to form a load break fuse cutout fully closed. In which, the fuse tube device 2 comprises: an insulation housing 20, an accommodation tube, a first electrical connection unit, a second electrical connection unit, a conductive rod 23, a fuse element 24, a first conductive plate 25, a second conductive plate 27, an accommodation member 28, a mass block 29, a stopping block 2A, a first cover C1, and a second cover C2. In practicable embodiments, the fuse element 24 can be a spiral wound fuse wire or a straight fuse wire.

According to the present invention, a top and a bottom of the insulation housing 20 have a first opening 2V1 and a second opening 2V2, respectively, and a first embedding member 201 and a second embedding member 202 are formed on a first side of the insulation housing 20. In addition, a hooking member 203 is provided on a second side of the insulation housing 20, and the hooking member 203 has a hooking opening consisting of a horizontal rectangular portion 2031, a vertical rectangular portion 2032 and a circular portion 2033. It is worth mentioning that, there are a plurality of weathersheds 20F disposed on the insulation housing 20.

As described in more detail below, the accommodation tube 2T and the first electrical connection unit 21 are both disposed in the insulation housing 20. Moreover, the first electrical connection unit 21 comprises a first cylinder member 211 and a first electrical terminal 212 connected with the first cylinder member 211, wherein the first cylinder member 211 has a first connection opening 2111 and a second connection opening 2112, one end of the accommodation tube 2T passes through the second connection opening 2112 so as to be positioned in the first cylinder member 211, and the first electrical terminal 212 protrudes out of the insulation housing 20 through the first embedding member 201. On the other hand, the second electrical connection unit 22 is disposed in the insulation housing 20, and comprises a second cylinder member 221 and a second electrical terminal 222 connected with the second cylinder member 221. According to FIG. 4A, FIG. 4B and FIG. 4C, the second cylinder member 221 has a third connection opening 2211 and a fourth connection opening 2212, another one end of the accommodation tube 2T passes through the fourth connection opening 2212 so as to be positioned in the second cylinder member 221, and the second electrical terminal 222 protrudes out of the insulation housing 20 through the second embedding member 202. It is worth noting that, a first arc extinguishing member 212A is connected to a top end of the first electrical terminal 212, and a second arc extinguishing member 222A being connected to a top end of the second electrical terminal 222.

According to the present invention, the conductive rod 23 is disposed in the insulation housing 20, and has a first end and a second end, wherein the first end is positioned in the first cylinder member 211, and a first electrical member 231 being disposed on the first end. As described in more detail below, the fuse element 24 is disposed in the insulation housing 20, and has a first terminal and a second terminal, wherein the first terminal contacts the first electrical member 231. According to FIG. 4A, FIG. 4B, FIG. 4C, FIG. 5A, FIG. 5B, and FIG. 5C, the first conductive plate 25 is connected to the first cylinder member 211 for covering the first connection opening 2111, and a second electrical member 251 is disposed on an inner surface of the first conductive plate 25 for contacting the second terminal of the fuse element 24. Moreover, the second conductive plate 27 is stuck in the second cylinder member 221, and has a first through hole, wherein the conductive rod 23 passes through the first through hole, so as to make the second conductive plate 27 be positioned near the second end of the conductive rod 23. By such arrangements, the first electrical terminal 212 of the first electrical connection unit 21 is electrically coupled to the fuse element 24 and the conductive rod 23 through the first conductive plate 25, and second electrical terminal 222 of the second electrical connection unit 22 is electrically coupled to the conductive rod 23 through the second conductive plate 27. In other words, the first electrical terminal 212 is allowed to transmit current and/or voltage to the second electrical terminal 222 via the fuse element 24 and the conductive rod 23.

According to FIG. 4A, FIG. 4B, FIG. 4C, FIG. 5A, FIG. 5B, and FIG. 5C, the first cover C1 is connected to the insulation housing 20 for shielding the first opening 2V1, and has a first recess C11 for receiving the first conductive plate 25 and a portion of the first cylinder member 211. On the other hand, the second cover C2 is connected to the insulation housing 20 for shielding the second opening 2V2. In one embodiment, the second cover C2 is made of an elastic material, and has a second recess C21 that is formed with a third opening C20 on a bottom thereof. Moreover, it can be seen that there are a plurality of narrow grooves C22 formed on the second cover C2 to surround the third opening C20.

According to the present invention, the accommodation member 28 is disposed in the second recess C21, wherein a top and a bottom of the accommodation member 28 have a fourth opening 281 and a fifth opening 282, respectively. Moreover, the fifth opening 282 is designed to be larger than the third opening C20, and the second conductive plate 27 simultaneously covers the fourth opening 281. It can be seen that there are a plurality of vent holes 27V formed on the second conductive plate 27. According to FIG. 4A, FIG. 4B, FIG. 4C, FIG. 5A, FIG. 5B, and FIG. 5C, the mass block 29, is disposed in the accommodation member 28, and has a recessed groove for receiving the second end of the conductive rod 23. It is worth mentioning that, the mass block 29 is coated with a polymer layer. On the other hand, the stopping block 2A, is disposed on the second plate 27 and has a second through hole, wherein the conductive rod 23 simultaneously passes through the second through hole.

As described in more detail below, the corrugated gasket 2B is disposed on the stopping block 2A, and has a third through hole, wherein the conductive rod 23 simultaneously passes through the third through hole. Moreover, the first tube (i.e., long arc extinguishing tube) 2D is disposed in the accommodation tube 2T and accommodates the conductive rod 23 therein, wherein two ends of the first tube 2D contact (withstand) the first conductive plate 25 and the corrugated gasket 2B, respectively. On the other hand, the second tube (i.e., short arc extinguishing tube) 2C is disposed in the first tube 2D, wherein two ends of the second tube 2C contact (withstand) the second electrical member 251 and the first electrical member 231, respectively.

Figure 6A:
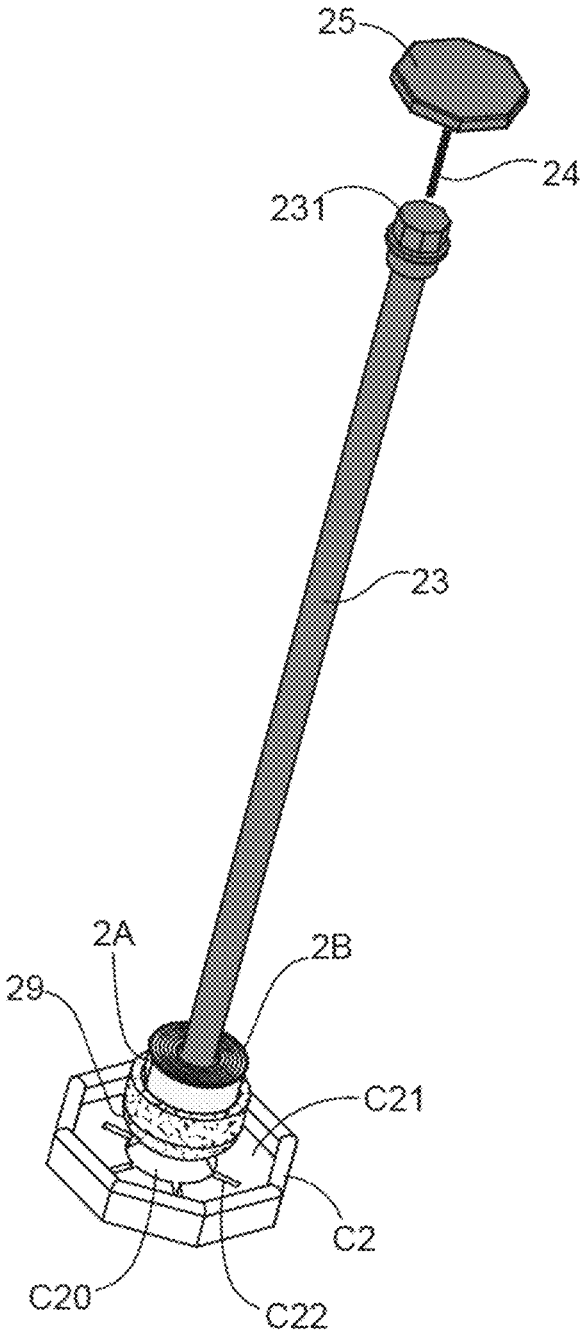
FIG. 6A shows a first diagram for stereo viewing a conductive rod, a fuse element, a mass block, and a second cover that are shown in FIG. 5A.
Figure 6B:
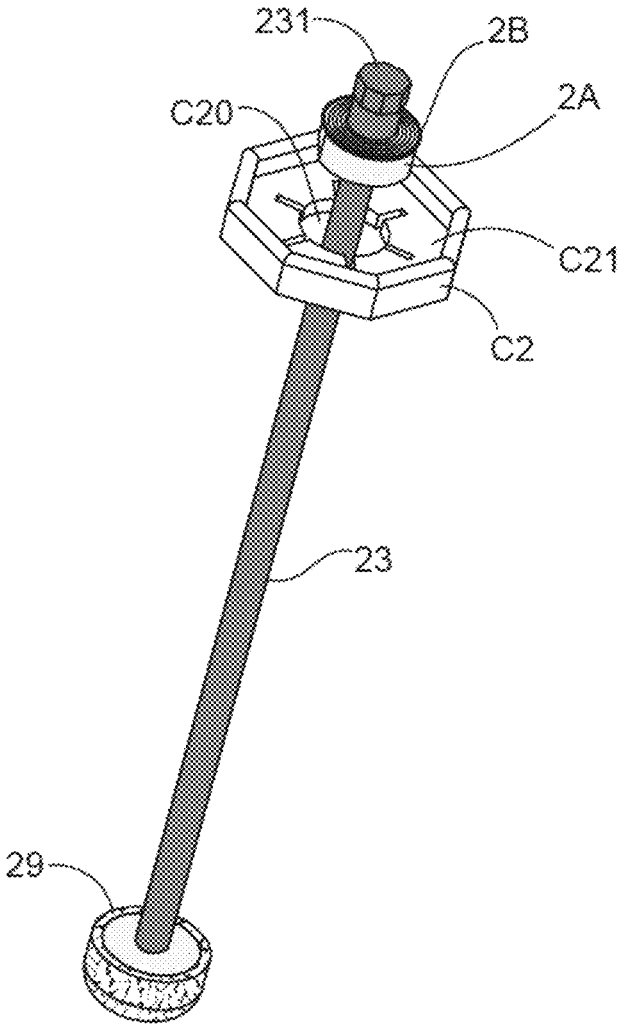
FIG. 6B shows a second diagram for stereo viewing the conductive rod, the fuse element, the mass block, and the second cover that are shown in FIG. 5A.

With reference to FIG. 6A and FIG. 6B, there are shown two diagrams for stereo viewing the conductive rod 23, the fuse element 24, the mass block 29, and the second cover C2 that are shown in FIG. 5A. It can be seen that, two ends of the second tube 2C are covered by the second electrical member 251 and the first electrical member 231, such that the second tube 2C has an arc extinguishing room (cavity) therein. Therefore, in case of overcurrent causes the fuse element 24 in the arc extinguishing room of the second tube 2C to melt, suddenly produced electric arc burns the arc extinguishing layer that is coated on the inner walls of the second tube 2C, thereby producing a significant amount of gas in the arc extinguishing room. As a result, the significant amount of gas causes high air pressure occurring in the arc extinguishing room, such that the first electrical member 231 and the conductive rod 23 are pushed by the high air pressure, so as to move downward. As FIG. 6A and FIG. 6B show, the mass block 29 has an arc bottom surface. Therefore, with the successively downward moving of the conductive rod 23, the mass block 29 eventually protrudes out of the second cover C2 after passing through the third opening C20 by the arc bottom surface thereof. According to FIG. 5A and FIG. 6B, it can be seen that, the second conductive plate 27 stuck in the second cylinder member 221 is also connected to the accommodation member 28 for covering the fourth opening 281, and the stopping block 2A is disposed on the second conductive plate 27. As such, after the mass block 29 protrudes out of the second cover C2 as well as the conductive rod 23 keep move downward, the first electrical member 231 is consequently blocked by the corrugated gasket 2B and the stopping block 2A, thereby stopping conductive rod 23 from downward moving. In addition, it is worth mentioning that, the second tube 2C (i.e., short arc extinguishing tube) and the main body of the conductive rod 23 are both accommodated in the first tube 2D (i.e., long arc extinguishing tube). As such, with the downward moving of the conductive rod 23, the gas produced in the arc extinguishing room of the second tube 2C flows in the first tube 2D, subsequently flows into the accommodation member 28 via the vent holes 27V of the second conductive plate 27, and consequently flows into the air through the fifth opening of the accommodation member 28 and the third opening C20 of the second cover C2.

Load Break Fuse Cutout Assembly Fully Closed

Figure 7A:
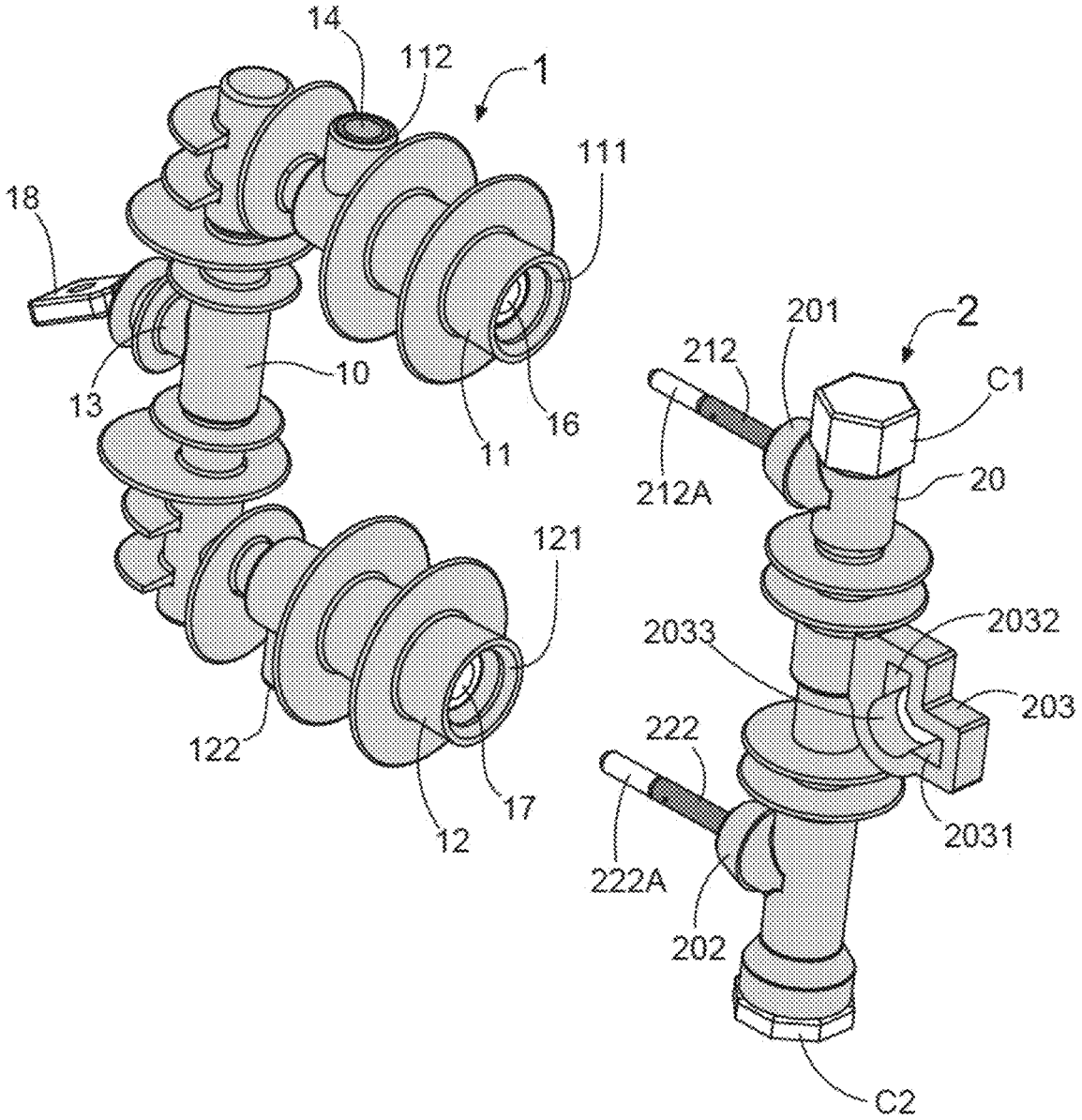
FIG. 7A shows a first stereo diagram of a load break fuse cutout fully closed according to the present invention.
Figure 7B:
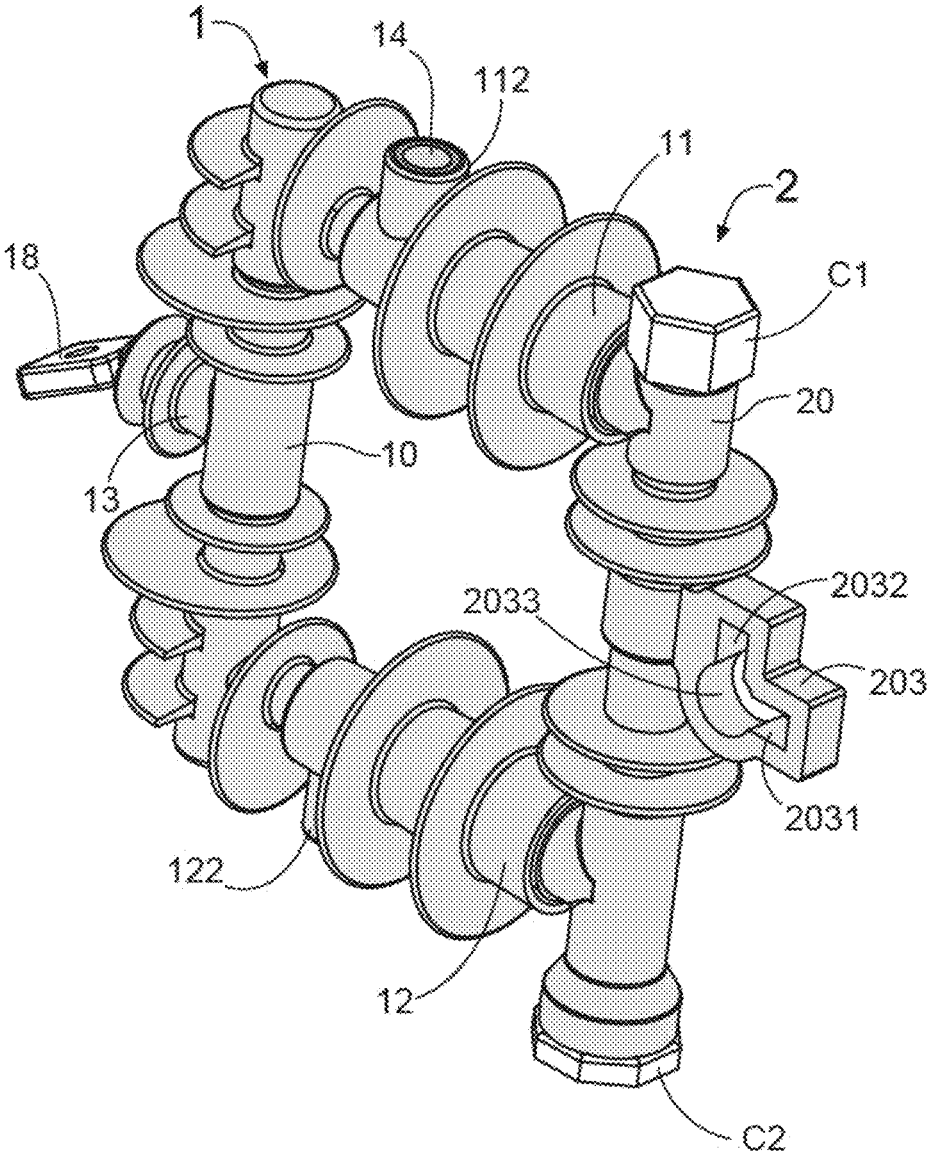
FIG. 7B shows a second stereo diagram of the load break fuse cutout fully closed according to the present invention.
Figure 7C:
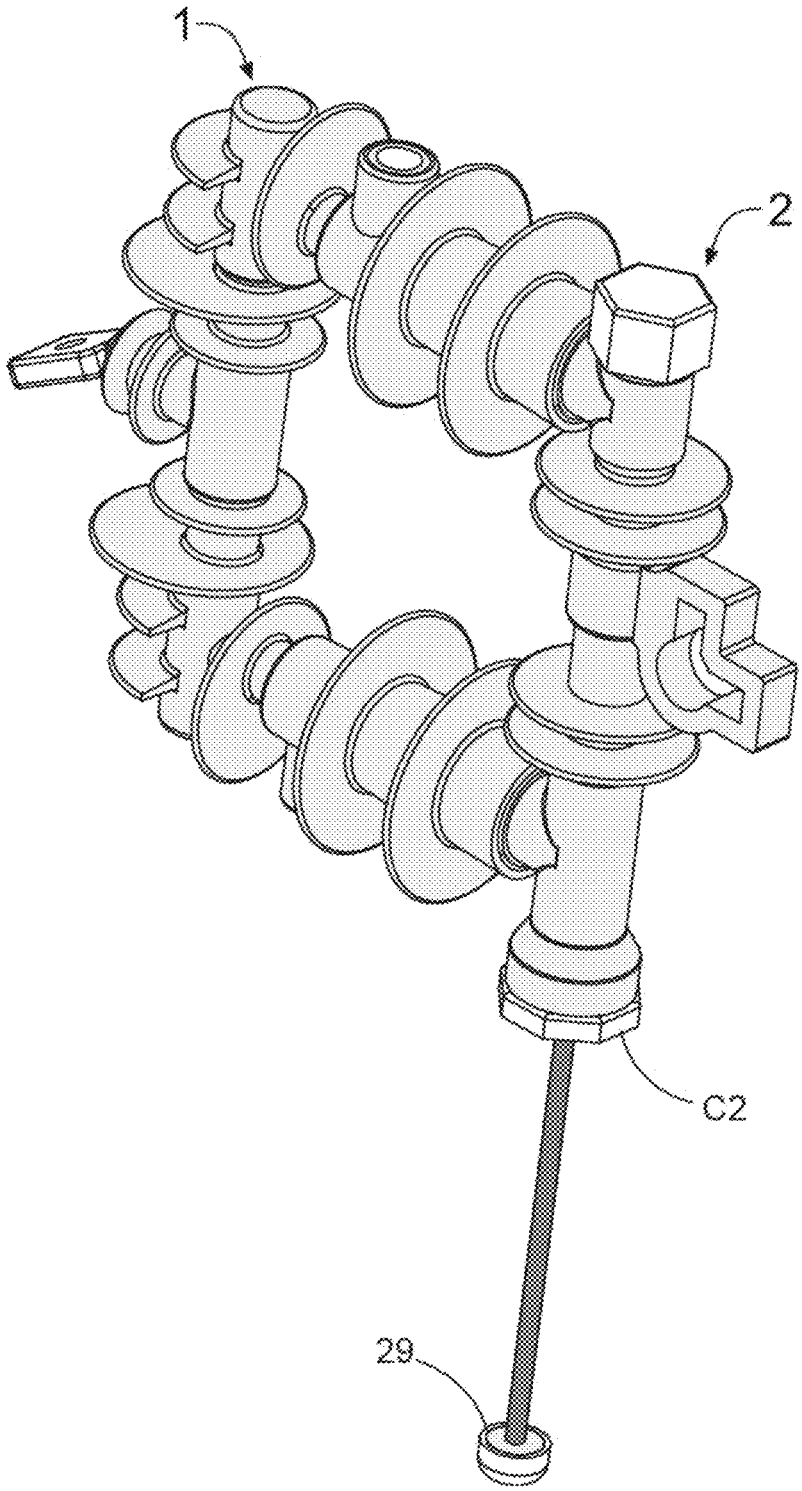
FIG. 7C shows a third stereo diagram of the load break fuse cutout fully closed according to the present invention.

With reference to FIG. 7A, FIG. 7B and FIG. 7C, there are shown three stereo diagrams of a load break fuse cutout fully closed according to the present invention. According to FIG. 7A, FIG. 7B and FIG. 7C, the fuse tube device 2 mentioned above is allowed to be assembled with an insulation device 1 so as to form a load break fuse cutout fully closed. The insulation device 1 mainly comprises: a full-closed cylindrical insulator 10 oriented vertically, a first cylindrical insulator 11 oriented horizontally and having a first end and a second end, a second cylindrical insulator 12 oriented horizontally and having a third end and a fourth end, a third cylindrical insulator 13 oriented horizontally and having a fifth end and a six end, wherein the full-closed cylindrical insulator 10, the first cylindrical insulator 11, the second cylindrical insulator 12, and the third cylindrical insulator 13 are made integratedly so as to form a main insulation body of the insulation device 2. Moreover, the first end of the first cylindrical insulator 11 is connected to the full-closed cylindrical insulator 10, the second end of the first cylindrical insulator 11 has a first terminal connecting opening 111, and a first cable connection opening 112 is formed on one side of the first cylindrical insulator 11. Particularly, a first electrical connection unit 14 is accommodated in the first cylindrical insulator 11, and has a first terminal connecting member that is positioned in the first terminal connecting opening 111 and a first able connecting member that is positioned in the first cable connection opening 112.

On the other hand, the third end of the second cylindrical insulator 12 is connected to the full-closed cylindrical insulator 10, the fourth end of the second cylindrical insulator 12 has a second terminal connecting opening 121, and a second cable connection opening 122 is formed on one side of the second cylindrical insulator 12. Moreover, a second electrical connection unit 15 is accommodated in the second cylindrical insulator 12, and has a second terminal connecting member that is positioned in the second terminal connecting opening 121 and a second cable connecting member that is positioned in the second cable connection opening 122. As such, wherein when assembling the fuse tube device 2 with the insulation device 1, the first embedding member 201 and the second embedding member 202 of the insulation housing 20 are embedded into the first terminal connecting opening 111 and the second terminal connecting opening 121, such that the first electrical terminal 212 and the second electrical terminal 222 contact the first terminal connecting member and the second terminal connecting member, respectively.

As described in more detail below, the third cylindrical insulator 13 is connected to the full-closed cylindrical insulator 10 by the fifth end thereof, so as to be positioned at a position on a center segment of the full-closed cylindrical insulator 10. Moreover, the sixth end of the third cylindrical insulator 13 has an opening. According to FIG. 7A, FIG. 7B and FIG. 7C, a mounting bracket 18 is disposed in the full-closed cylindrical insulator 10, wherein the mounting bracket 18 comprises a supporting member and a mounting member, and the supporting member is embedded in the opening so as to be connected to a structural member that is disposed in the full-closed cylindrical insulator 10. Moreover, the mounting member is connected with the supporting member 181, and is exposed out of the third cylindrical insulator 13.

Moreover, a first arc extinguishing unit 16 is accommodated in the first cylindrical insulator 11, and comprises a tube connector, a conductive member and an arc extinguishing tube. In which, the tube connector contacts the first electrical connection unit 14 in the first cylindrical insulator 11. On the other hand, a second arc extinguishing unit 17 is accommodated in the second cylindrical insulator 12, and also comprises a tube connector, a conductive member and an arc extinguishing tube. In which, the tube connector contacts the second electrical connection unit 15 in the second cylindrical insulator 12. By such arrangements, after the first embedding member 201 and the second embedding member 202 are embedded into the first terminal connecting opening 111 and the second terminal connecting opening 121, the first arc extinguishing member 212A disposed on the top end of the first electrical terminal 212 passes through the arc extinguishing tube of the first arc extinguishing unit 16 so as to contact the tube connector, and the first electrical terminal 212 eventually electrically coupled to the first electrical connection unit 14 through the tube connector. Moreover, the second arc extinguishing member 222A disposed on the top end of the second electrical terminal 222 passes through the arc extinguishing tube of the second arc extinguishing unit 17 so as to contact the tube connector, and the second electrical terminal 222 eventually electrically coupled to the second electrical connection unit 15 through the tube connector.

Therefore, through above descriptions, all embodiments and their constituting elements of the fuse tube device and the load break fuse cutout assembly having the fuse tube device proposed by the present invention have been introduced completely and clearly; in summary, the present invention includes the advantages of:

(1) According to FIG. 7A and FIG. 7B show, the present invention discloses an insulation device 1, which is allowed to be assembled with a fuse tube device 2 so as to form a load break fuse cutout fully closed. Therefore, after said load break fuse cutout is applied in an electric power system for use in primary overhead feeder lines and taps to protect distribution transformers from current surges and overloads, there is no chance for birds, kites, and/or branches to cause electrocution by touching the conductive articles that are accommodated in the main insulation body of the insulation device 1 and/or the insulation housing 20 of the fuse tube device 2.

(2) According to FIG. 7A and FIG. 7B, the insulation housing 20 has a hooking member 203 having a hooking opening that consists of a horizontal rectangular portion 2031, a vertical rectangular portion 2032 and a circular portion 2033. By such arrangements, an engineering staff is allowed to operate a live working tool to firstly connect the horizontal rectangular portion 2031, thereby pulling the fuse tube device 2 backward to make the first terminal 21 (second terminal 22) leave the first terminal connecting opening 111 (second terminal connecting opening 121). Subsequently, the engineering staff is allowed to operate the live working tool to connect the vertical rectangular portion 2032, such that the fuse tube device 2 is supported by the live working tool. Eventually, the engineering staff can operate the live working tool to move the fuse tube device 2 to the ground. In other words, it is practicable for the engineering staff staying on the ground to control the live working tool to replace the fuse tube device 2 of the load break fuse cutout 1 by a new one.

(3) According to FIG. 6A, FIG. 6B, FIG. 7A, and FIG. 7B, in case of overcurrent causes the fuse element 24 in the arc extinguishing room of the second tube 2C to melt, suddenly produced electric arc burns the arc extinguishing layer that is coated on the inner walls of the second tube 2C, thereby producing a significant amount of gas in the arc extinguishing room. As a result, the significant amount of gas causes high air pressure occurring in the arc extinguishing room, such that the first electrical member 231 and the conductive rod 23 are pushed by the high air pressure, so as to move downward. With the successively downward moving of the conductive rod 23, the mass block 29 eventually protrudes out of the second cover C2 after passing through the third opening C20 by the arc bottom surface thereof. Furthermore, it can be seen that, after the mass block 29 protrudes out of the second cover C2 as well as the conductive rod 23 keep move downward, the first electrical member 231 is consequently blocked by the corrugated gasket 2B and the stopping block 2A, thereby stopping conductive rod 23 from downward moving. As a result, an engineering staff can easily know that the fuse tube device 2 of a specific load break fuse cutout assembly is needed to be replaced by a new one.

The above description is made on embodiments of the present invention.

However, the embodiments are not intended to limit scope of the present invention, and all equivalent implementations or alterations within the spirit of the present invention still fall within the scope of the present invention.

What is claimed is:

1. A fuse tube device, comprising:

an insulation housing, wherein a top and a bottom of the insulation housing have a first opening and a second opening, respectively, and a first embedding member and a second embedding member are formed on a first side of the insulation housing;

an accommodation tube, being disposed in the insulation housing;

a first electrical connection unit, being disposed in the insulation housing, and comprising a first cylinder member and a first electrical terminal connected with the first cylinder member; wherein the first cylinder member has a first connection opening and a second connection opening, one end of the accommodation tube passing through the second connection opening so as to be positioned in the first cylinder member, and the first electrical terminal protruding out of the insulation housing through the first embedding member;

a second electrical connection unit, being disposed in the insulation housing, and comprising a second cylinder member and a second electrical terminal connected with the second cylinder member; wherein the second cylinder member has a third connection opening and a fourth connection opening, another one end of the accommodation tube passing through the fourth connection opening so as to be positioned in the second cylinder member, and the second electrical terminal protruding out of the insulation housing through the second embedding member;

a conductive rod, being disposed in the insulation housing, and having a first end and a second end, wherein the first end is positioned in the first cylinder member, and a first electrical member being disposed on the first end;

a fuse element, being disposed in the insulation housing, and having a first terminal and a second terminal, wherein the first terminal contacts the first electrical member;

a first conductive plate, being connected to the first cylinder member for covering the first connection opening, and a second electrical member is disposed on an inner surface of the first conductive plate for contacting the second terminal of the fuse element;

a first cover, being connected to the insulation housing for shielding the first opening, and having a first recess for receiving the first conductive plate and a portion of the first cylinder member;

a second conductive plate, being stuck in the second cylinder member, and having a first through hole, wherein the conductive rod passes through the first through hole, so as to make the second conductive plate be positioned near the second end of the conductive rod; and a second cover, being connected to the insulation housing for shielding the second opening.

2. The fuse tube device of claim 1, wherein there is a hooking member provided on a second side of the insulation housing, and the hooking member having a hooking opening that consists of a horizontal rectangular portion, a vertical rectangular portion and a circular portion.

3. The fuse tube device of claim 1, wherein the fuse element is selected from a group consisting of spiral wound fuse wire and straight fuse wire.

4. The fuse tube device of claim 1, wherein the insulation housing is provided with a plurality of weathersheds thereon.

5. The fuse tube device of claim 1, wherein a first arc extinguishing member is connected to a top end of the first electrical terminal, and a second arc extinguishing member being connected to a top end of the second electrical terminal.

6. The fuse tube device of claim 1, wherein there are a plurality of vent holes formed on the second conductive plate.

7. The fuse tube device of claim 1, wherein the second cover is made of an elastic material, and having a second recess that is formed with a third opening on a bottom thereof.

8. The fuse tube device of claim 7, wherein there are a plurality of narrow grooves formed on the second cover to surround the third opening.

9. The fuse tube device of claim 8, further comprising:

an accommodation member, being disposed in the second recess, wherein a top and a bottom of the accommodation member have a fourth opening and a fifth opening, respectively, the fifth opening being larger than the third opening, and the second conductive plate simultaneously covering the fourth opening;

a mass block, being disposed in the accommodation member, and having a recessed groove for receiving the second end of the conductive rod;

a stopping block, being disposed on the second plate and having a second through hole, wherein the conductive rod simultaneously passes through the second through hole;

a corrugated gasket, being disposed on the stopping block, and having a third through hole, wherein the conductive rod simultaneously passes through the third through hole;

a first tube, being disposed in the accommodation tube and accommodating the conductive rod therein, wherein two ends of the first tube contact the first conductive plate and the corrugated gasket, respectively; and a second tube, being disposed in the first tube, wherein two ends of the second tube contact the second electrical member and the first electrical member, respectively.

10. The fuse tube device of claim 9, wherein the mass block is coated with a polymer layer.

11. A load break fuse cutout assembly, comprising:

an insulation device, comprising:

a full-closed cylindrical insulator oriented vertically;

a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;

a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;

a first electrical connection unit, being accommodated in the first cylindrical insulator, and having a first terminal connecting member that is positioned in the first terminal connecting opening and a first cable connecting member that is positioned in the first cable connection opening;

a second electrical connection unit, being accommodated in the second cylindrical insulator, and having a second terminal connecting member that is positioned in the second terminal connecting opening and a second cable connecting member that is positioned in the second cable connection opening; and a fuse tube device, comprising:

an insulation housing, wherein a top and a bottom of the insulation housing have a first opening and a second opening, respectively, and a first embedding member and a second embedding member are formed on a first side of the insulation housing;

an accommodation tube, being disposed in the insulation housing;

a first electrical connection unit, being disposed in the insulation housing, and comprising a first cylinder member and a first electrical terminal connected with the first cylinder member; wherein the first cylinder member has a first connection opening and a second connection opening, one end of the accommodation tube passing through the second connection opening so as to be positioned in the first cylinder member, and the first electrical terminal protruding out of the insulation housing through the first embedding member;

a second electrical connection unit, being disposed in the insulation housing, and comprising a second cylinder member and a second electrical terminal connected with the second cylinder member; wherein the second cylinder member has a third connection opening and a fourth connection opening, another one end of the accommodation tube passing through the fourth connection opening so as to be positioned in the second cylinder member, and the second electrical terminal protruding out of the insulation housing through the second embedding member;

a conductive rod, being disposed in the insulation housing, and having a fifth end and a sixth end, wherein the fifth end is positioned in the first cylinder member, and a first electrical member being disposed on the fifth end;

a fuse element, being disposed in the insulation housing, and having a first terminal and a second terminal, wherein the first terminal contacts the first electrical member;

a first conductive plate, being connected to the first cylinder member for covering the first connection opening, and a second electrical member is disposed on an inner surface of the first conductive plate for contacting the second terminal of the fuse element;

a first cover, being connected to the insulation housing for shielding the first opening, and having a first recess for receiving the first conductive plate and a portion of the first cylinder member;

a second conductive plate, being stuck in the second cylinder member, and having a first through hole, wherein the conductive rod passes through the first through hole, so as to make the second conductive plate be positioned near the sixth end of the conductive rod; and a second cover, being connected to the insulation housing for shielding the second opening;

wherein when assembling the fuse tube device with the insulation device, the first embedding member and the second embedding member are embedded into the first terminal connecting opening and the second terminal connecting opening, such that the first electrical terminal and the second electrical terminal contact the first terminal connecting member and the second terminal connecting member, respectively.

12. The load break fuse cutout assembly of claim 11, wherein there is a hooking member provided on a second side of the insulation housing, and the hooking member having a hooking opening that consists of a horizontal rectangular portion, a vertical rectangular portion and a circular portion.

13. The load break fuse cutout assembly of claim 11, wherein the fuse element is selected from a group consisting of spiral wound fuse wire and straight fuse wire.

14. The load break fuse cutout assembly of claim 11, wherein the insulation housing is provided with a plurality of weathersheds thereon.

15. The load break fuse cutout assembly of claim 11, wherein a first arc extinguishing member is connected to a top end of the first electrical terminal, and a second arc extinguishing member being connected to a top end of the second electrical terminal.

16. The load break fuse cutout assembly of claim 11, wherein there are a plurality of vent holes formed on the second conductive plate.

17. The load break fuse cutout assembly of claim 11, wherein the second cover is made of an elastic material, and having a second recess that is formed with a third opening on a bottom thereof.

18. The load break fuse cutout assembly of claim 17, wherein there are a plurality of narrow grooves formed on the second cover to surround the third opening.

19. The load break fuse cutout assembly of claim 18, wherein the fuse tube device further comprises:

an accommodation member, being disposed in the second recess, wherein a top and a bottom of the accommodation member have a fourth opening and a fifth opening, respectively, the fifth opening being larger than the third opening, and the second conductive plate simultaneously covering the fourth opening;

a mass block, being disposed in the accommodation member, and having a recessed groove for receiving the sixth end of the conductive rod;

a stopping block, being disposed on the second plate and having a second through hole, wherein the conductive rod simultaneously passes through the second through hole;

a corrugated gasket, being disposed on the stopping block, and having a third through hole, wherein the conductive rod simultaneously passes through the third through hole;

a first tube, being disposed in the accommodation tube and accommodating the conductive rod therein, wherein two ends of the first tube contact the first conductive plate and the corrugated gasket, respectively; and a second tube, being disposed in the first tube, wherein two ends of the second tube contact the second electrical member and the first electrical member, respectively.

20. The load break fuse cutout assembly of claim 19, wherein the mass block is coated with a polymer layer.

* * * * *